United States Patent [19]

Pezzoli et al.

[11] Patent Number: 4,982,767

[45] Date of Patent: Jan. 8, 1991

[54] WEAR INDICATOR FOR WEFT GRIPPER STRAP

[75] Inventors: Luigi Pezzoli, Leffe; Luigi Favini, Galbiate, both of Italy

[73] Assignee: Vamatex S.p.A., Villa Di Serio, Italy

[21] Appl. No.: 348,425

[22] Filed: May 8, 1989

[51] Int. Cl.[5] ..... D03D 47/00

[52] U.S. Cl. ..... 139/449; 188/1.11; 116/208

[58] Field of Search ..... 139/445, 444, 446, 449; 428/240, 244; 138/122, 129, 154; 188/1.11; 474/264, 266; 198/502.1; 152/154.2; 116/208

[56] References Cited

U.S. PATENT DOCUMENTS

| | | | |
|---|---|---|---|
| 2,285,929 | 6/1942 | Jacobson | 116/208 |
| 3,362,376 | 1/1968 | Norton | 188/1.11 X |
| 3,814,160 | 6/1974 | Creasey | 152/154.2 |
| 3,987,822 | 10/1976 | Freisler | 139/449 |
| 4,074,742 | 2/1978 | Chamblin | 152/154.2 |
| 4,102,363 | 7/1978 | Deborde | 139/449 |
| 4,119,123 | 10/1978 | Samuels | 138/129 |
| 4,283,455 | 8/1981 | McGee | 428/240 |
| 4,690,177 | 9/1987 | Gehring et al. | 139/449 |

FOREIGN PATENT DOCUMENTS

| | | | |
|---|---|---|---|
| 749846 | 4/1970 | Belgium. | |
| 2030433 | 12/1971 | Fed. Rep. of Germany | 139/449 |
| 3042054 | 6/1982 | Fed. Rep. of Germany | 139/449 |
| 757175 | 12/1933 | France | 116/208 |
| 2582322 | 11/1986 | France. | |
| 0102588 | 3/1984 | European Pat. | |

*Primary Examiner*—Andrew M. Falik

*Attorney, Agent, or Firm*—Young & Thompson

[57] ABSTRACT

A strap controlling the motion of weft yarn grippers in shuttleless looms, allowing to detect its state of wear, is provided with layers or inserts distributed according to the thickness and positioned along the length of the strap, adapted to supply optic, electric or magnetic signals indicating the wear of the strap.

4 Claims, 3 Drawing Sheets

WEAR INDICATOR FOR WEFT GRIPPER STRAP

BACKGROUND OF THE INVENTION

The present invention concerns an improved strap controlling the motion of weft yarn grippers in shuttleless looms.

It is known that the straps—usually having a composite structure based on plastic material reinforced with various types of fibers—which control the motion of weft yarn grippers in looms undergo rather fast wear, owing to the strong stresses to which they are subjected due to their function. The straps wear on the sides and on the upper and lower surfaces; above all, it is the lateral areas of the upper surface, more frequently stressed, which get worn due to the bending movements of the straps. Since these movements, as well as the stresses and wear of the straps depend on the highly variable accelerations which the straps, undergo in their motion, the wear is very uneven both transversally to the straps and longitudinally thereto.

Due to wear, the straps have to be replaced fairly frequently, and obviously before wearing to the extent of possibly breaking, which would be seriously prejudicial to the proper performance of the loom and to the actual safety of the operators. This requires frequent undesired checks, which are a waste of time for the operators and limit the loom productivity. In fact, these checks cannot be carried out immediately and need to be thorough, particularly in correspondence of the bottom surface of the strap which bears on the lower warp web in the shed.

SUMMARY OF THE INVENTION

To eliminate or at least reduce this drawback, the present invention proposes to detect at once and constantly—either through direct perception by the loom operators or by sending and processing signals—the state of wear of the strap, and it provides for the purpose a strap controlling the motion of weft yarn grippers in looms, characterized in that it comprises layers or inserts, distributed according to the thickness and positioned along the length of the strap, adapted to supply optic, electric or magnetic signals indicating the wear of said strap.

A particularly simple embodiment of the invention provides for the presence, in the strap, of superposed layers of different colors, or of one or more colored inserts, allowing to immediately recognize, once a certain order of the different colors in the sense of the strap thickness has been established, the wear level of said strap, from the color gradually taken up by its parts wearing more rapidly.

If the strap has a composite laminated structure—as it often happens—it will be sufficient to give a different color to the single layers of said structure; whereas, if the strap has a compact structure, it will be necessary to introduce into the body of said structure, while the strap is being formed, one or more colored sheet inserts, parallel to the major surfaces of the strap, at a suitable reciprocal distance, according to the thickness of the actual strap.

A second, more sophisticated embodiment of the invention provides for the insertion, into the strap, of layers or wires which are electrically conductive, or magnetized, or capable of sending, reflecting or refracting luminous beams, adapted to cooperate with electric contacts or with electric, electronic, magnetic or optic detectors, so as to supply electric, magnetic or optic signals indicating the wear of the strap, which may then be processed and used for a direct intervention on the loom, or for indicating to the operator the state of wear of the strap.

This second embodiment of the strap can be obtained with different modifications according to the requirements having to be satisfied.

BRIEF DESCRIPTION OF THE DRAWINGS

The invention is now described in further detail, with reference to the accompanying drawings, which illustrate some preferred embodiments thereof and in which.

DESCRIPTION OF THE PREFERRED EMBODIMENTS

Figure 1:
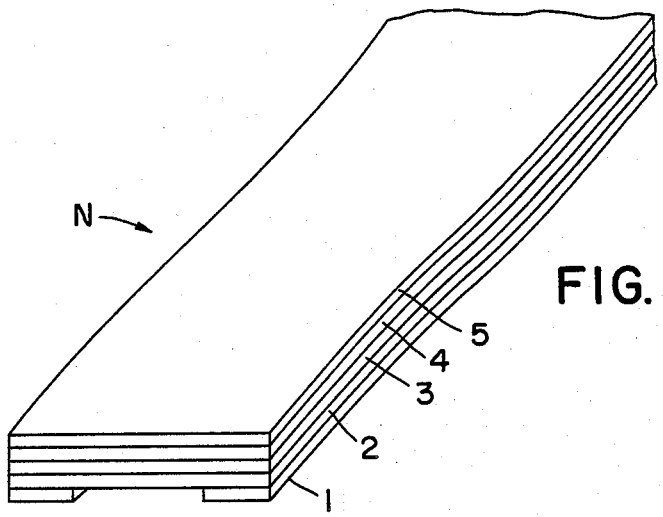
FIG. 1 is a discontinued perspective view of a first embodiment, with colored layers, of the strap according to the invention.

FIG. 1 of the drawings illustrates a first embodiment of the invention wherein the strap N is of the composite laminated type. Each of the four upper layers 2, 3, 4 and 5, forming the strap, has a distinctly different color from that of the other layers and from that of the bottom layer 1, for instance red, yellow, green, blue, whereby the operator, on simply observing the strap N, will be able to check how and to what extent the strap has worn, after a certain period of use, and to establish whether it may be possible to wait some time before making a further check (blue), or whether the strap has to be kept under more or less close checking (green, yellow), or finally whether the strap has to be replaced (red). In this case, the invention is evidently used to allow the operator to check directly the state of wear of the strap and to intervene personally.

The situation changes if, instead of having differently colored layers, the strap has (as in the embodiments of FIGS. 2 to 7) layers or inserts provided with particular properties—optical, electrical or magnetic—in respect of the remaining inert composition of the strap. In fact, in this second case, the layers or inserts may send or transmit optic, electric or magnetic signals which, appropriately picked up by suitable detectors, preferably supply electric signals indicating the wear of the strap, which signals can be used, not only to directly warn the operator, but also to automatically stop the loom after having been suitably processed.

Figure 2:
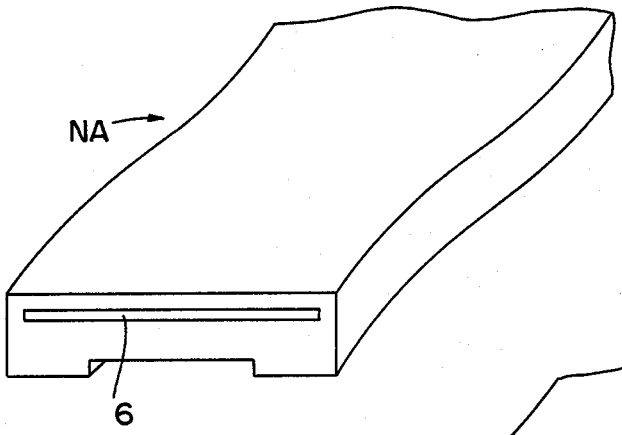
FIG. 2 is a similar perspective view of a second embodiment of the strap according to the invention, the structure of which comprises a single sheet insert.

The embodiment of FIG. 2 of the strap NA according to the invention provides for only one insert 6, in the form of a single flat sheet of suitable thickness and material, to be incorporated lengthwise to the strap, and thus for a single signal to be sent when the wear has already reached the stage of jeopardizing the proper working of the loom.

Figure 3:
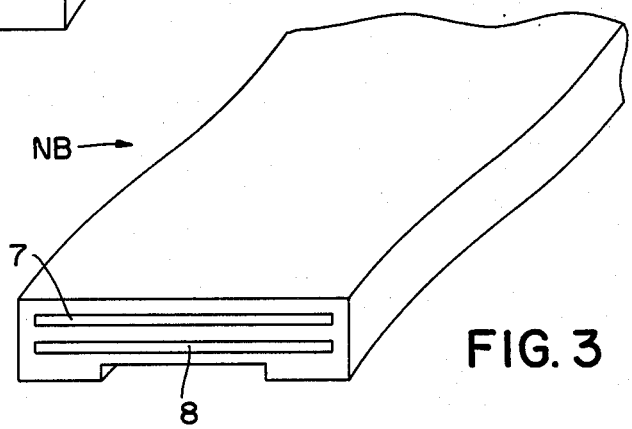
FIGS. 3 to 5 illustrate different modifications of the strap embodiment of FIG. 2, with a structure having several superposed and/or offset inserts.
Figure 4:
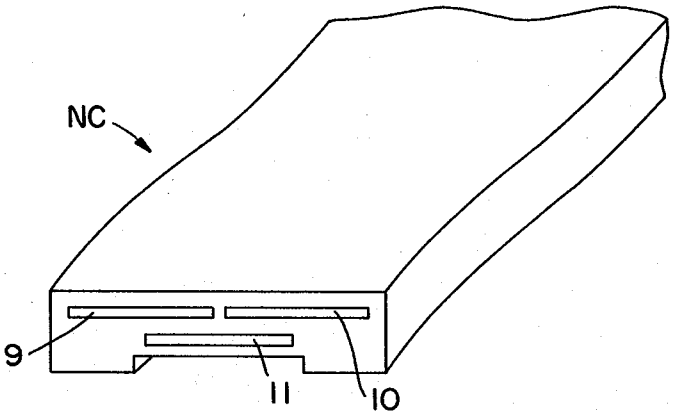
Figure 5:
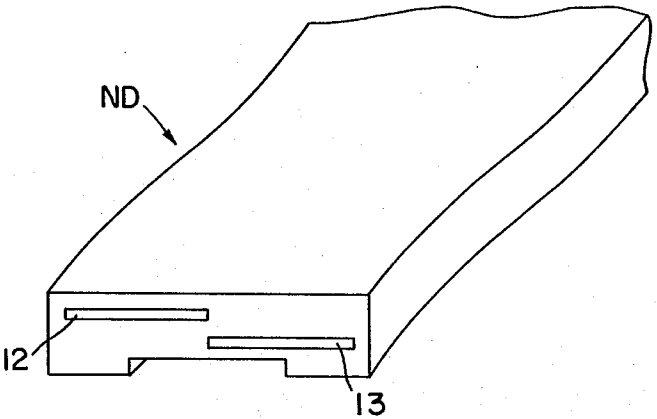

Whereas, the embodiments of the straps NB, NC and ND, shown in FIGS. 3 to 5, provide for multiple inserts: two equal superposed flat sheets 7 and 8 in FIG. 3; two side-by-side sheets 9 and 10 placed over a third central sheet 11 of equal width in FIG. 4; and two offset sheets 12 and 13 on two superposed planes in FIG. 5. It is thus possible to obtain more signals for different states of wear of the strap and a more accurate and continuous checking.

Figure 6:
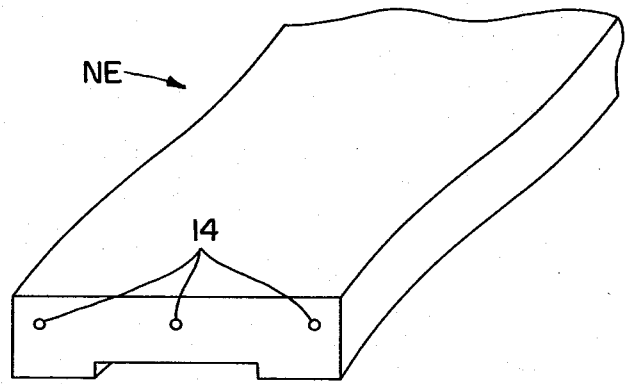
FIGS. 6 and 7 show a third embodiment of the strap, with longitudinally positioned inserts, in the form of sheets or filaments, respectively positioned onto one or onto two superposed planes.
Figure 7:
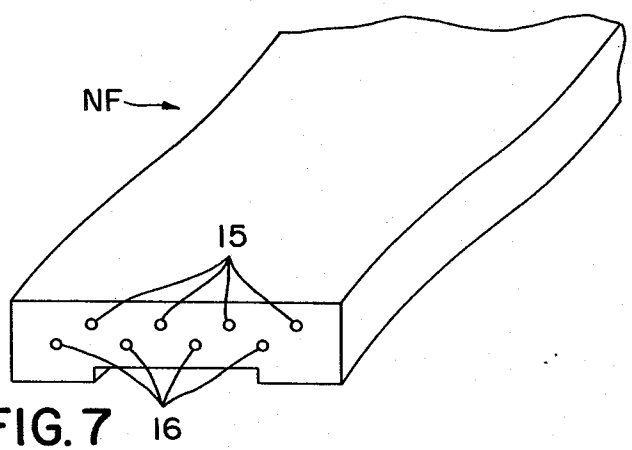

Inserts in the form of wires are provided in the embodiments of the strap shown in FIGS. 6 and 7. In the first of these embodiments, three wires 14 extend along the strap NE, positioned on a single plane, and the strap behaves more or less like the strap NA of FIG. 2 (even though—since it is possible in this case to send three signals—a selective check can also be obtained, if desired); in the second embodiment, the strap NF is longitudinally crossed by four wires 15, positioned substantially on the same plane as the wires 14 of the strap of FIG. 6, and by four wires 16, positioned on an underlying plane and offset in respect of the wires 15; the strap NF can thus be used in a similar way to those of FIGS. 3 to 5, however also in this case with far greater possibilities of selection.

In all these embodiments the inserts may be electric conductors, magnetized sheets or wires, or bodies adapted to send, reflect or refract light: the signals which they are adapted to send or transmit—when they are bare, due to wear of the strap covering them on their lower part—can be transmitted to the operator either directly, or (preferably) after suitable amplification, conversation and/or processing, so as to allow him to intervene, or else they can be processed and transmitted to the loom so as to cause the stopping thereof.

Figure 9:
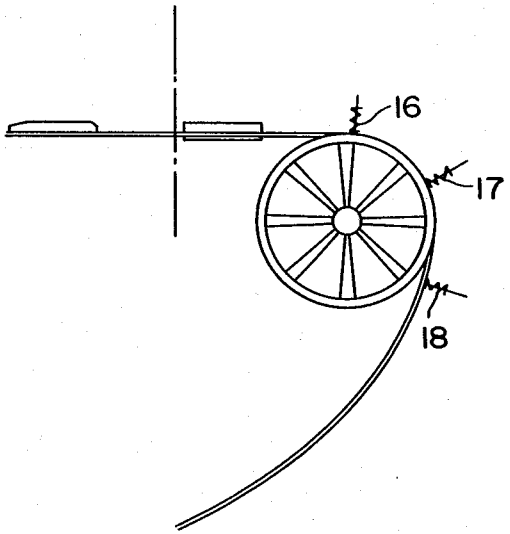
FIG. 9 indicates possible positionings of said circuit or of other means receiving the signals sent or transmitted by the strap according to the invention.
Figure 8:
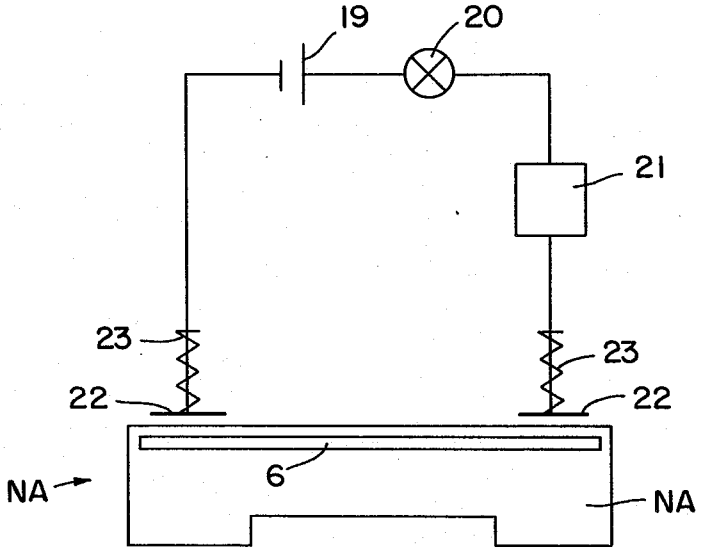
FIG. 8 is a diagram illustrating a very simple circuit to detect and indicate the state of wear of the strap according to the invention.

It is possible, for example, to apply in correspondence of any one of the points 16, 17 or 18 (FIG. 9) of the loom (to be chosen in relation to the loom structure and to planning requirements) a detecting and/or signaling circuit and/or means, of the type of those—very simple—illustrated in FIG. 8.

FIG. 8 shows an electric circuit comprising an energy source 19, a signaling member in the form of a bulb 20 or like, and an amplifying and/or processing device 21, the circuit being made through a strap NA according to the invention (of the type of that shown in FIG. 2) and pressing with brushes 22, under the action of springs 23, against the upper lateral surfaces of said strap.

The circuit stays open so long as the strap is not worn to the extent of leaving bare the sheet insert 6. It instead closes—through said insert 6 which is conductive—when this latter emerges from the plastic material incorporating it, so as to contact the brushes 22.

As the circuit closes, the signaling bulb 22 lights up, warning the operator that the loom should be stopped. The bulb 22 may of course be replaced or associated with other signaling means (as a ringer), or with more sophisticated automatic means for the direct control of the loom working, as for example—in the simplest case—by a relay stopping the loom motor.

In the case of the embodiments of FIGS. 2 to 5, the sheet inserts may even be simple colored inserts, whereby the strap represents a modification of the strap embodiment of FIG. 1, or they could be sheets adapted to send, transmit or refract luminous rays, in which case this strap embodiment would have to be equipped with suitable optic or photoelectric detectors.

Also further embodiments of the invention are possible: for example, one could adopt laminations with the various layers of the strap varying in thickness, so as to "read" with optic or other kinds of detectors the approaching of dangerous wear conditions. These could obviously be signaled in different ways, according to the level of danger, in a particularly precise and sophisticated manner.

We claim:

1. The combination of a shuttleless loom and a weft yarn gripper strap, said strap controlling motion of weft yarn grippers along a shed, characterized in that it comprises a plurality of inserts, positioned along the length and within the thickness of the strap, adapted to supply signals indicating wear of said strap prior to a time at which the strap must be replaced.

2. The combination as in claim 1, having a composite laminated structure, each layer being of a different color.

3. The combination as in claim 1, having cavities extending parallel to surfaces of the strap, and spaced apart from one another, said cavities receiving sheet inserts each of a different color.

4. The combination as in claim 1, wherein the strap has two wide parallel sides and two thin parallel sides, at least one of the plurality of inserts being positioned in the strap closer to one of the two wide parallel sides than the other of the two wide parallel sides.

* * * * *